US006276034B1

(12) United States Patent
Bachman et al.

(10) Patent No.: US 6,276,034 B1
(45) Date of Patent: Aug. 21, 2001

(54) SLAT WALL DEATH CARE MERCHANDISE DISPLAY UNIT WITH CATEGORY DELINEATOR

(75) Inventors: Douglas E. Bachman, Columbus, OH (US); Alton F. Doody, New Orleans, LA (US)

(73) Assignee: The York Group, Inc., Houston, TX (US)

( * ) Notice: Subject to any disclaimer, the term of this patent is extended or adjusted under 35 U.S.C. 154(b) by 0 days.

(21) Appl. No.: 09/205,579

(22) Filed: Dec. 4, 1998

(51) Int. Cl.[7] ..... A61G 17/00

(52) U.S. Cl. ..... 27/27; 40/657; 211/85.16; 52/36.5

(58) Field of Search ..... 40/657; 52/36.4, 52/36.5; 211/94.01, 94.02, 153, 162, 90.01, 90.02, 90.04, 85.16; 27/1, 27; D6/468

(56) References Cited

U.S. PATENT DOCUMENTS

| | | | |
|---|---|---|---|
| D. 293,865 | * | 1/1988 | Robertson . |
| D. 350,246 | | 9/1994 | Louise et al. . |
| D. 351,076 | | 10/1994 | Eliadis et al. . |
| D. 393,963 | * | 5/1998 | Mansour . |
| D. 397,562 | | 9/1998 | DePottey et al. . |
| 1,297,405 | * | 3/1919 | Saunders ..... 40/657 X |
| 3,190,243 | | 6/1965 | Pira . |
| 3,585,944 | | 6/1971 | Scheer . |
| 4,591,058 | * | 5/1986 | Amstutz et al. . |
| 4,805,783 | * | 2/1989 | Mayer . |
| 4,891,897 | | 1/1990 | Gieske et al. . |
| 4,944,416 | * | 7/1990 | Petersen et al. . |
| 4,961,295 | * | 10/1990 | Kosch, Sr. et al. . |
| 5,138,803 | * | 8/1992 | Grossen . |
| 5,142,832 | * | 9/1992 | Branham, Sr. et al. . |
| 5,228,579 | * | 7/1993 | Kaufman . |
| 5,370,249 | | 12/1994 | Harvey et al. . |
| 5,495,954 | | 3/1996 | Schmit . |
| 5,622,010 | | 4/1997 | Weber . |
| 5,655,674 | * | 8/1997 | Holztrager . |
| 5,709,052 | * | 1/1998 | Szabo, Sr. et al. . |
| 5,709,411 | * | 1/1998 | Bartling et al. . |
| 5,711,115 | | 1/1998 | Wirt . |
| 5,759,045 | | 6/1998 | Gabig et al. . |
| 5,775,034 | | 7/1998 | Logue . |
| 5,775,521 | * | 7/1998 | Tisbo . |
| 5,901,862 | * | 5/1999 | Riga et al. . |
| 5,941,026 | * | 8/1999 | Eisenrich et al. . |

* cited by examiner

*Primary Examiner*—B. Dayoan
*Assistant Examiner*—William L. Miller
(74) *Attorney, Agent, or Firm*—Stevens Davis Miller & Mosher, L.L.P.

(57) ABSTRACT

A slat wall death care merchandise display unit comprising a back wall with a plurality of slats attached such that a plurality of parallel, uniform slots are created. A category delineator can be inserted to divide and organize the display of death care related merchandise. Additionally, a cornice can be inserted into at least one slot to provide a display location for category headers. Moreover, an illumination source can be hidden under the cornice to provide additional lighting in the viewing of the death care related merchandise.

17 Claims, 3 Drawing Sheets

SLAT WALL DEATH CARE MERCHANDISE DISPLAY UNIT WITH CATEGORY DELINEATOR

FIELD OF THE INVENTION

The present invention relates to an integrated display utilizing at least one category delineator on a slat wall display to aid in the display of death care merchandise such as cards, flowers, pictures, books, personal memorabilia, caskets, coffins, urns, burial vaults, and materials for decorating or adorning the same. The display system of the invention is particularly designed for use by prospective purchasers in a preview room. In addition, it may be useful for displaying death care merchandise in funeral product stores.

BACKGROUND OF THE INVENTION

Display units are known in the art. For example, U.S. Pat. No. 3,190,243 discloses a display that has used a plurality of spaced threaded holes to provide fastening locations for shelves. As disclosed in U.S. Pat. No. 3,585,944, displays have also included shelving made for suspension from the eaves of a roof. These types of shelving structures can hang from a transversely projecting cleat and can be fastened to the wall by a plurality of claws biting into the roof.

Additionally, display panels using slat walls are known. For example, U.S. Pat. No. 4,891,897 discloses a slat wall display panel that uses fasteners with cleats that must be slid in from the side of the slat wall. Moreover, display furniture has included the use of support brackets that can be fixedly attached in slots between adjacent panels as disclosed in U.S. Pat. No. 5,370,249. Finally, even the use of tray shelves that can be engaged in lip troughs on slat walls is known to the art as disclosed in U.S. Pat. No. 5,622,010. While this configuration has offered more flexibility, even this arrangement still does not provide the separation of the merchandise envisioned in the present invention.

Furthermore, the prior art has not provided an effective system for using slat wall displays in a death care merchandise integrated display system. The present invention overcomes these shortcomings while offering an additional advantage of a category delineator to help organize the display of death care merchandise.

SUMMARY OF THE INVENTION

A slat wall death care merchandise display unit maximizes the types and styles of death care merchandise that can be displayed. The present invention comprises a back wall containing a plurality of parallel slats wherein the slats allow at least one category delineation fixture to be inserted into at least one of the plurality of slots formed by the spacing of the slats attached to the back wall. Additionally, the display unit may further comprise an overhead cornice attached to at least one slot to allow the hanging of at least one category header capable of displaying signs, placards, or similar notification.

This configuration offers the flexibility to provide consumers with a versatile array of death care merchandise and related articles.

DETAILED DESCRIPTION OF PREFERRED EMBODIMENT

The present invention provides an integrated display system for death care related merchandise. The display system of the present invention is principally used in a preview room where selection of death care related merchandise by the decedent's loved one occurs. In addition, the display system of the invention may be used to display death care merchandise in funeral product stores.

The display system of the invention is defined by a back wall containing a plurality of parallel, spaced slats. These slats are evenly spaced to allow the insertion of at least one category delineator into at least one slot created by the uniform arrangement of the slats attached to the back wall. Additionally, the present invention may comprise a cornice inserted into at least one slot in the back wall. The cornice allows the attachment of at least one category header capable of displaying information for the purposes of indication and identification of the death care related merchandise being displayed. This information may be presented by attaching placards, signs, and the like to the category header.

Figure 1:
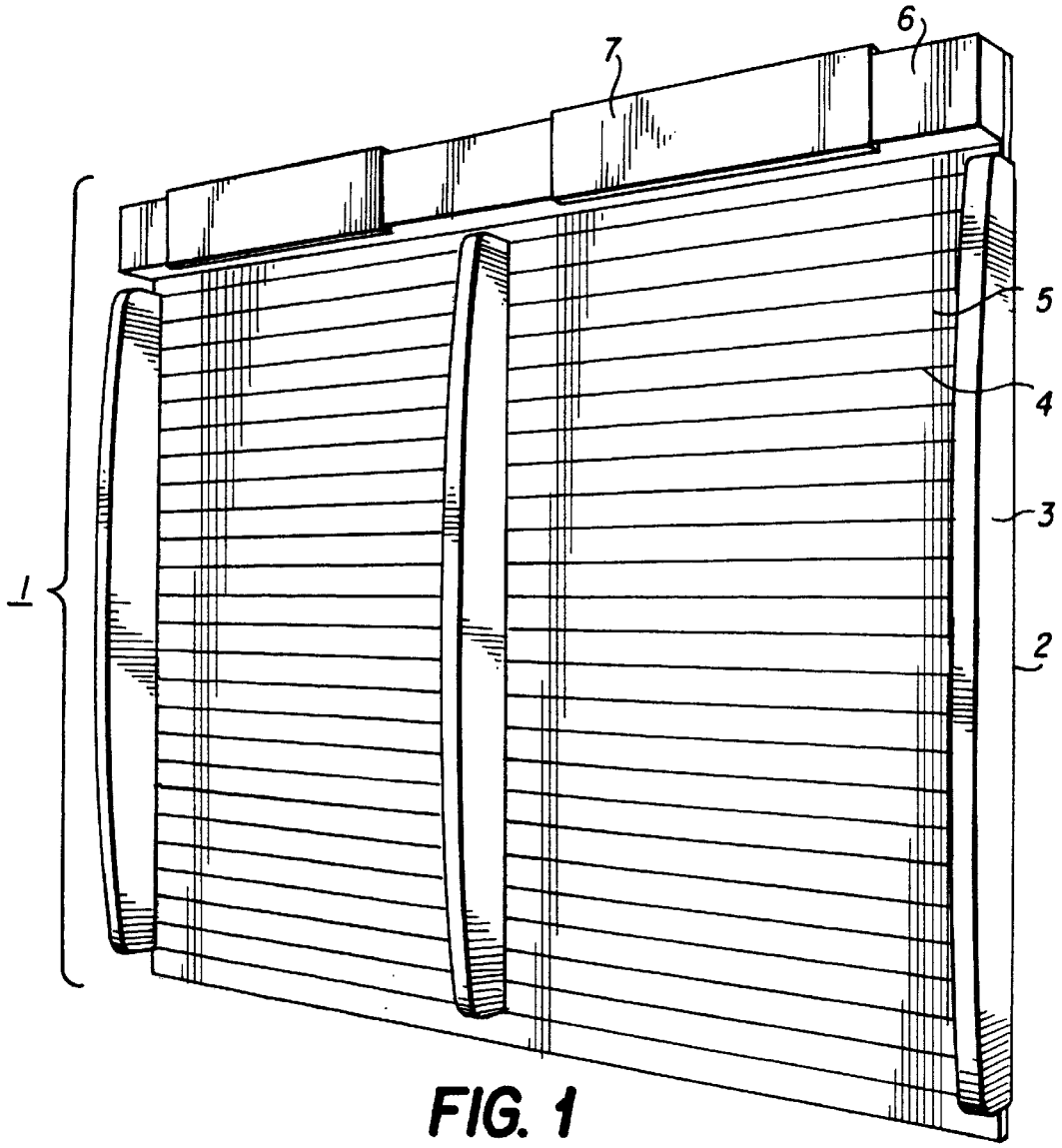
FIG. 1 is a perspective view of the slat wall death care merchandise display unit with a plurality of category delineators attached and a plurality of cornice category headers attached.

As set forth in FIG. 1, a slat wall death care merchandise display unit 1 comprises a plurality of parallel spaced slats 5 wherein the attachment of the slats 5 are evenly spaced to create a plurality of uniform slots 4 along a back wall 2. For stability, the back wall 2 should be attached to any wall of a building where the display unit 1 will be displayed.

Figure 3:
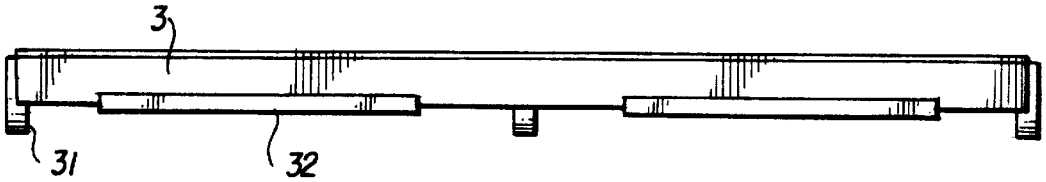
FIG. 3 is a plan view of the category delineator.
Figure 2:
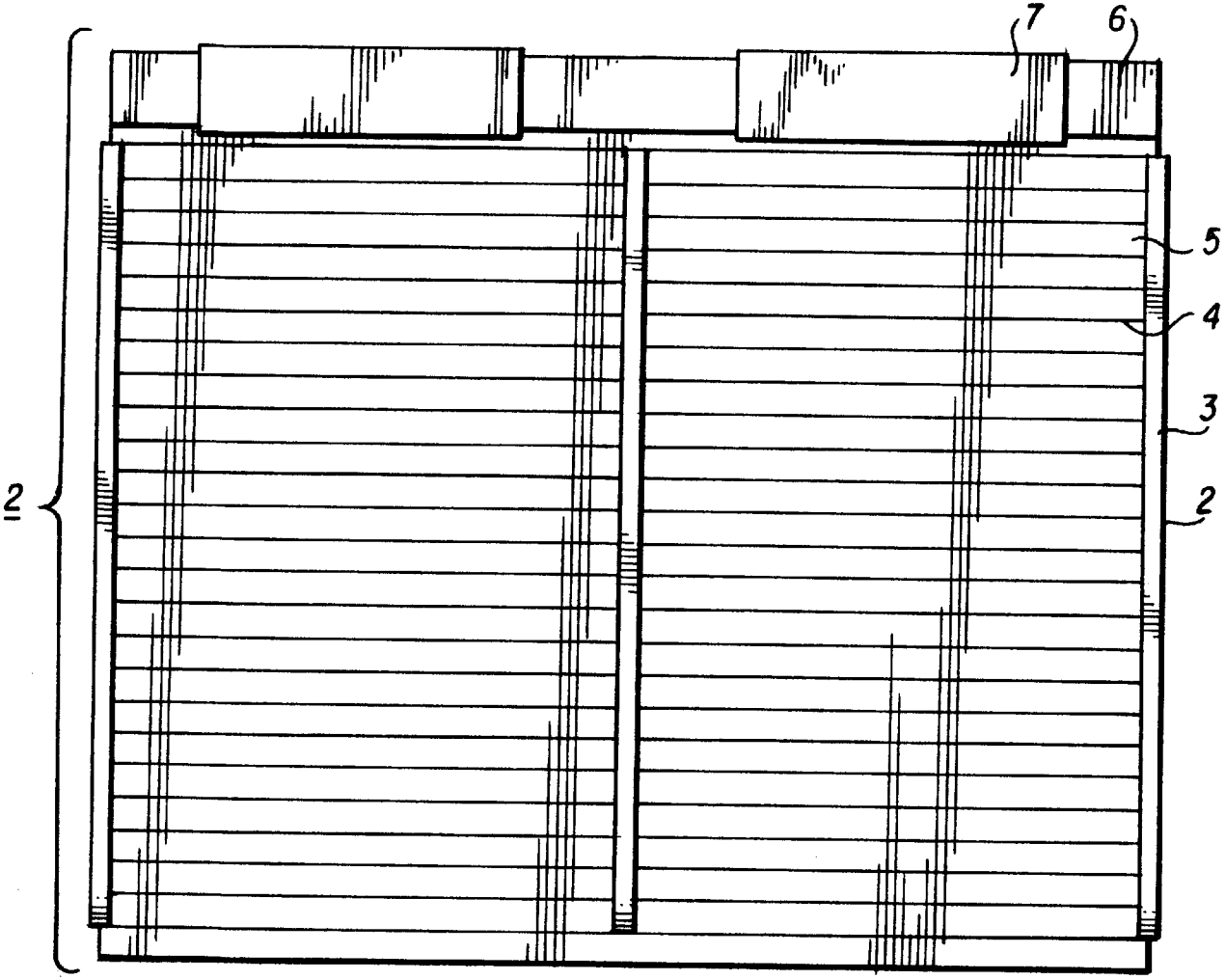
FIG. 2 is an elevation view of the slat wall death care merchandise display unit.

These slots 4 provide a fastening location for at least one category delineator 3. Additionally, the display unit 1 may comprise a cornice 6 attached to at least one slot in the back wall 2. The cornice 6 provides a location for at least one category header 7 to hang by a fastener, preferably at least one J-hook fastener. The category header 7 hangs on the cornice assembly 6 and provides information of interest to those in need of death care related merchandise. FIGS. 1 and 2 show a preferred embodiment of the display unit 1 from a perspective view and an elevation view, respectively. As shown in FIG. 3, a plan view of a preferred embodiment of the category delineator 3, the category delineator 3 comprises at least one fastening location 31 capable of interfacing with at least one slot 4 between the slats 5 attached to the back wall 2 of the display unit 1. To attach the category delineator 3, the category delineator 3 is aligned such that the fastening location 31 can approach and enter a slot 4. When the fastening location 31 is positioned in the slot 4, a rearmost edge 32 of the category delineator 3 may make contact with the slats 5 attached to the back wall 2 of the display unit 1. At this time, the category delineator 3 may be released, allowing gravity to force the fastening location 31 to come into contact with at least one slot 4. This arrangement effectively fastens the category delineator 3 to the display unit 1.

Figure 4:
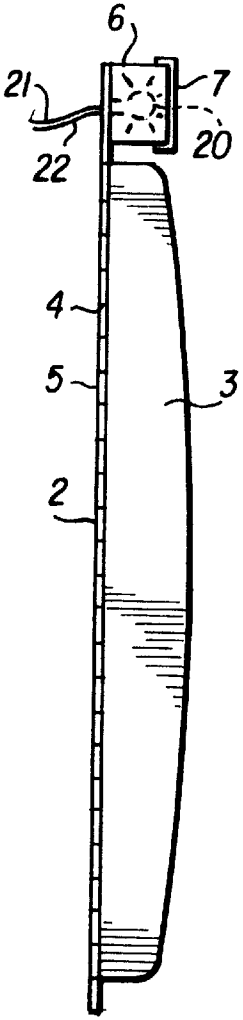
FIG. 4 is a side view of the slat wall death care merchandise display unit.

As shown in FIG. 4, a side view of the display unit 1, the category delineator 3, when affixed, may rest such that the rearmost surface 32 of the category delineator 3 comes into contact with the slats 5. Additionally, a fastener can be used for fixation of a category header 7 onto a cornice 6 wherein the cornice is inserted into at least one slot 4. In this arrangement, the display unit 1 can provide both information via the category headers 7 and organization through proper utilization of the category delineators 3.

As used herein, the term "decedent confinement chamber" shall refer to a casket, coffin, or burial vault, and, when appropriate, urns. The term shall include ready for use caskets, coffins, and burial vaults, the facade of caskets, coffins, and burial vaults, and sectionals and miniatures thereof. Where the displays are to be used in a preview room and designed not to be open, it is specially preferred to use facades 24 of such caskets, coffins, and burial vaults. The facade typically includes those outer sides and surfaces of the chamber visible to the observer. Where the chamber is being used to exhibit only the facade, the inner chamber is hollow.

The display unit 1 may further contain one or more display boards for displaying accessories typically used with decedent confinement chambers on display. Such accessories include fabrics for the cap panel—that portion of the interior of the chamber lining the upper part of the lid—and the overlay—the fabric which lies across the outside of the decedent confinement chamber when the lid of the chamber is open. Additionally, samples of ornamental trims for the exterior of the chamber can be displayed. Moreover, the front surface of the category header 7 may contain additional information about the death care merchandise being displayed.

Figure 5:
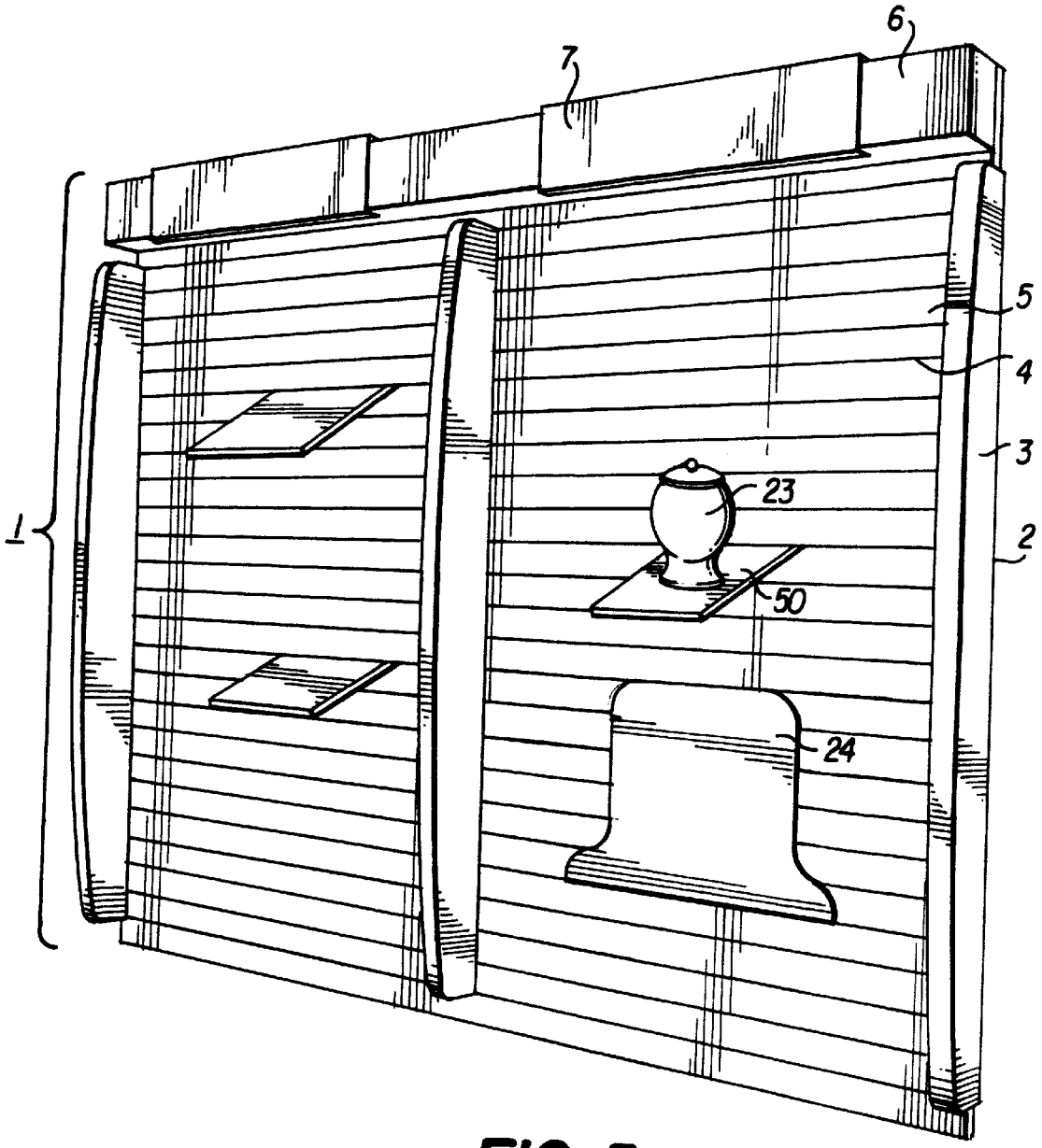
FIG. 5 is a perspective view showing the attachment of shelving.

Moreover, as shown in FIG. 5, at least one shelf 50 could be used. Shelves 50 may comprise horizontally flat sections onto which death care related merchandise could be displayed. These shelves 50 can be inserted into at least one slot 4 or can be affixed using at least one conventional attachment fastener to the slats 5.

Merchandise such as urns 23 and miniature decedent confinement chambers may be displayed on the shelf 50. Additionally, the shelf 50 can provide a good location to display at least one full, sectional, or miniaturized decedent confinement chamber, adornment materials, or any other death care related merchandise.

The display 1 may further contain a cornice 6. Any conventional cornice or soffit disclosed in the art may suffice. Typically, the use of a cornice will increase the display height of the display unit 1 to above seven feet. As shown in FIGS. 1, 2, and 5, the cornice 6 is inserted into at least one slot 4. Alternatively, the cornice 6 could be attached to the back wall 2.

An illuminating source 20 may be concealed to the observer within the interior or the bottom surface of the cornice 6. Exemplary of the illumination sources are one or more track or pendant lights which may easily be manipulated such that the light is directed onto selected merchandise within the display unit 1. The illuminating source can be attached to the bottom surface of the cornice by conventional screws or nuts and bolts. Any necessary electrical cable wiring leads 21, 22 out of the cornice 6 through an aperture in the back wall 2. The electrical wiring is not evident to the observer of the display unit 1.

These category headers 7 provide information about the displayed merchandise when the unit is employed for point of sale merchandise. For example, in point of sale merchandise, the information center can display information about the materials used in the manufacture of the decedent confinement chamber, as well as information about the merchandise on display.

A finish on any or all of the surfaces of the merchandise display unit may be placed to more closely coordinate with the merchandise being displayed. For instance, where the merchandise display is of caskets or coffins, the back wall 2 of the display unit 1 may be pigmented to enhance the colors of the merchandise.

Various modification may be made in the nature, composition, operation, and the arrangement of the various elements, steps, and procedures described herein without departing from the spirit and scope of the invention as defined in the following claims.

We claim:

1. A slat wall death care merchandise display unit comprising:

a back wall having a plurality of parallel spaced slats attached to the back wall such that a plurality of uniform, parallel slots are formed, said parallel slots extending from a lowermost portion to an uppermost portion of said back wall; a cornice inserted into at least one of said uniform, parallel slots at said uppermost portion of said back wall; and at least one vertical category delineator inserted into at least two of said uniform, parallel slots, one of said slots located beneath said cornice and another of said slots located at said lowermost portion of said back wall.

2. The display unit of claim 1 further comprising an illumination source affixed to a bottom surface of the cornice wherein any electrical wiring of the illumination source passes through an aperture in the back wall.

3. The display unit of claim 1 further comprising at least one shelf inserted into at least one of said uniform, parallel slots.

4. The display unit of claim 3 further comprising a decedent confinement chamber wherein the shelf supports the decedent confinement chamber.

5. The display unit of claim 4 wherein the decedent confinement chamber is a full size sectional, facade, or miniature of a coffin, casket, burial vault, or urn.

6. The display unit of claim 3 further comprising death care related merchandise wherein the shelf supports at least one item of death care related merchandise.

7. The display unit of claim 1 further comprising at least one category header attached to a top edge of the cornice.

8. The display unit of claim 1 further comprising at least one decedent confinement chamber wherein the decedent confinement chamber is fastened to the back wall.

9. The display unit of claim 8 wherein the decedent confinement chamber is a full size, sectional, facade, or miniature of a coffin, casket, burial vault, or urn.

10. The display unit of claim 1 further comprising death care related merchandise wherein the death care related merchandise is attached to the slats on the back wall.

11. The display unit of claim 1 which further comprises:

hanging at least one category header from a top edge of the cornice; and attaching an illumination source to a bottom surface of the cornice and passing any electrical wiring of the illumination source through an aperture in the back wall.

12. A method of making a slat wall death care merchandise display unit which comprises:

attaching a plurality of uniform parallel slats to a back wall such that a plurality of uniform, evenly spaced slots are created between the slats, said parallel slats extending from a lowermost portion to an uppermost portion of said back wall; attaching a cornice into at least one of said evenly spaced slots at said uppermost portion of said back wall; and attaching a vertical category delineator inserted into at least two of said evenly spaced slots, one of said slots located beneath said cornice and another of said slots located at said lowermost portion of said back wall.

13. A method of using a slat wall death care merchandise display unit having a cornice which comprises:

attaching, beneath said cornice, a plurality of death care related merchandise on a plurality of evenly spaced slats on a back wall of said display unit in which said evenly spaced slats form a plurality of evenly spaced uniform slots between the slats, said evenly spaced slots extending from a lowermost portion to an uppermost portion of said back wall;

dividing the death care related merchandise with at least one vertical category delineator inserted into at least two of said evenly spaced uniform slots, one of said slots located beneath said cornice and another of said slots located at said lowermost portion of said back wall, whereby said death care merchandise is delineated into categories.

14. The method of using the display unit of claim 13 which further comprises:

placing at least one category header on a top edge of said cornice in which said cornice is inserted into at least one of said evenly spaced uniform slots.

15. The method of using the display unit of claim 14 which further comprises:

hanging said at least one category header from said top edge of the cornice; and attaching an illumination source to a bottom surface of the cornice and passing any electrical wiring of the illumination source through an aperture in the back wall.

16. The method of using the display unit of claim 15 which further comprises:

displaying at least one decedent confinement chamber wherein the display unit further comprises at least one shelf fastened into at least one of said evenly spaced slots and the decedent confinement chamber is supported by the shelf.

17. The method of using the display unit of claim 15 which further comprises:

displaying at least one additional death care related merchandise wherein the display unit further comprises at least one shelf inserted into at least one of said evenly spaced slots and the additional death care related merchandise is supported by the shelf.

* * * * *